US007156784B2

(12) United States Patent
Plavsic

(10) Patent No.: US 7,156,784 B2
(45) Date of Patent: Jan. 2, 2007

(54) DEVICE FOR OBTAINING A PREDEFINED LINEAR FORCE

(75) Inventor: Vojin Plavsic, Grangesberg (SE)

(73) Assignee: Vitamedic Sweden HB, Grangesberg (SE)

( * ) Notice: Subject to any disclaimer, the term of this patent is extended or adjusted under 35 U.S.C. 154(b) by 462 days.

(21) Appl. No.: 10/398,173

(22) PCT Filed: Oct. 9, 2001

(86) PCT No.: PCT/SE01/02194

§ 371 (c)(1),
(2), (4) Date: Apr. 2, 2003

(87) PCT Pub. No.: WO02/30520

PCT Pub. Date: Apr. 18, 2002

(65) Prior Publication Data

US 2004/0038785 A1 Feb. 26, 2004

(30) Foreign Application Priority Data

Oct. 9, 2000 (SE) ..... 00036301

(51) Int. Cl.
*A63B 21/00* (2006.01)

(52) U.S. Cl. ..... 482/121; 482/130; 482/137

(58) Field of Classification Search ..... 482/121, 482/133, 137, 104, 108, 105–107, 141, 140, 482/130

See application file for complete search history.

(56) References Cited

U.S. PATENT DOCUMENTS

| | | | | |
|---|---|---|---|---|
| 3,953,026 | A * | 4/1976 | Stokely | 482/123 |
| 4,231,568 | A * | 11/1980 | Riley et al. | 482/130 |
| 4,426,077 | A | 1/1984 | Becker | |
| 4,603,857 | A | 8/1986 | Chipman et al. | |
| 4,643,420 | A | 2/1987 | Riley et al. | |
| 4,988,095 | A | 1/1991 | Ferrari | |

FOREIGN PATENT DOCUMENTS

| | | |
|---|---|---|
| CA | 1 214 478 | 11/1986 |
| WO | 84/02659 | 7/1984 |

* cited by examiner

*Primary Examiner*—Jerome Donnelly
(74) *Attorney, Agent, or Firm*—Young & Thompson

(57) ABSTRACT

The present invention relates to a device for obtaining a predetermined linear force, including a first elastic force means (Ee 1, 56) and a force output means (16, 76) in the form of a non-elastic, flexible elongated member. The invention is characterised by a force transformation means (10, 12, 72) arranged between said first elastic force means and the force output means, such that a pulling of the force output means creates a tension in said first elastic force means, and wherein the force transformation means is arranged and designed such that the pulling force required on the force output means decreases with the distance ($X_2$) the force output means is pulled.

9 Claims, 4 Drawing Sheets

$Fe_3(0)$
$X_3(0)$
$Fe_3$
19
18
20
22
D
$S_2$
$X_2$
$O_2$
$\gamma$
$X_3$
r
E
R
16
$\beta$
$l_2$
$M_S$
$O_1$
$h_2$
$l_1$
$l_2$
$F_2$
$\beta$
$\alpha$
B
10
$h_1$
$l_1$
A
$X_{1/2}$
$X_{1/2}$
$M_2$
$M_1$
12
$X_1$
$F_1$
$S_1$
$Fe_1$
$Ee_1$
14

$F_S$
30
$S_2$
$X_2$
19
16
22
$l_2$
β
$O_1$
$Ee_3$
$l_1$
$l_2$
$F_2$
$h_2$
β
$Fe_3(0)$
$X_3(0)$
α
B
10
$h_1$
$l_1$
A
$X_{1/2}$
$X_{1/2}$
$M_2$
$M_1$
12
$X_1$
$F_1$
$S_1$
$Fe_1$
$Ee_1$
14

DEVICE FOR OBTAINING A PREDEFINED LINEAR FORCE

TECHNICAL FIELD

The present invention relates to a device for obtaining predetermined linear forces, and in particular to a device where the force obtained is substantially constant. These forces are primarily intended for training of the skeleton muscles, but due to its exceptional properties they can be used in various medical, technical and other applications where its features are beneficial.

BACKGROUND OF THE INVENTION

Most of the training equipment present on the market today are designed according to a few construction concepts: devices based on the movement of weights, devices comprising springs and other elastic elements, devices based on friction, actuators like clutches, brakes, fluid valves, (pneumatic, hydraulic), etc. and motor-driven devices.

In order to gain an insight into a training progression and to optimise the training result, it is extremely important to control the relevant movement parameters for muscles such as: load force, contraction speed, acceleration etc. The essential accent in this direction is to be able to exercise muscles with given load values.

When using weights, the gravitation force is used in order to obtain a load on the muscles. The mass of the weights is given and corresponds to the force of the weights during rest only. When lifting the weights during a certain time interval its mass is accelerated unavoidably. Any acceleration of a mass creates time dependent forces of inertia that are the product of the mass and the acceleration values during that time period.

From the medical, exercising and competition experience it is widely known that load variations caused by inertial force can be significant. Therefore, in order to enable some reasonably acceptable controlled training and avoid muscle and ligament injuries, lifting of weights has to be performed with as low as possible acceleration. Due to a relatively short weight lifting length, only relatively low speeds can be used in order to have a low acceleration. It will therefore be impossible during training with weights, or weight-based training equipment, to perform a movement with both arbitrary given muscle contraction loads and speeds simultaneously. Inertial force drastically restricts the freedom regarding selection of speed and acceleration in exercise. The limitation lies in the fact that instantaneous muscle power, strength or effects (product of muscle force and contraction speed) appearing during acceleration of a weight, can easily exceed a maximal tolerable value of a muscle, which value the muscle can't reach, or if reached the muscle can be injured. Consequently it is practically impossible to regularly exercise of the essential physical training magnitude i.e. the actual muscle strength.

During training with a so-called "isokinetic" machine, the problem is the reverse. In this case the speed of the muscle contraction is given, while the muscle load is arbitrarily fluctuating.

Further, weight-based training equipment has other drawbacks depending on their weight. They must therefore be placed in training facilities with robust under-carriage and should not be in movement or be swinging. Because weights during lifting can be moved only vertically, a certain orientation in space is always needed, which limits the freedom of the construction and the installation possibilities.

With friction-based equipment, a load is obtained which is dependent partly on acceleration, but particularly on speed. By continuously controlling a friction force with breaks, clutches and valves, the dependency of the movement dynamics can partly be reduced. However, the major drawback with using friction forces is that they are reactive and thereby passive, which prevents training with very favourable and desirable so called negative muscle work.

BRIEF DESCRIPTION OF THE INVENTION

The present invention has as an aim to provide a device that provides predetermined linear forces/torques, (increasing and decreasing), that gives the desired output depending on the area of application.

This is obtained with a device according to patent claim 1. Preferable embodiments are characterised by the dependent claims.

According to one aspect of the invention it is characterised by a device for obtaining a predetermined linear force, including a first elastic force means and a force output means in the form of a non-elastic, flexible elongated member, characterised by a force transformation means arranged between said first elastic force means and the force output means, such that a pulling of the force output means creates a tension in said first elastic force means, and wherein the force transformation means is arranged and designed such that the pulling force required on the force output means decreases with the distance the force output means is pulled.

According to another aspect of the invention it is characterised in that it includes a second elastic force means and a second force output means attached to said second elastic force means, wherein the pulling force required on the second force output means increases with the distance the force output means is pulled, that the two force output means are connected to each other such as to summarise the forces, and in that the characteristics of the two elastic force means are chosen such that the pulling force is substantially constant during the pulling distance.

According to a further aspect of the invention it is characterised in that the pulling end of said first force output means is attached to a rotation means rotatable around a shaft at a distance, in that the pulling end of said second force output means is attached to said rotation means at a distance such that a torque is obtained which is constant during turning of said rotation means.

The advantages with the present invention in contrast to known devices are several. By providing a force that decreases as the output means is pulled, where the decreasing force is proportional to the pulled length, several functions may be obtained. There are several applications where it is desirable to have such a decrease as the output means is pulled out.

Further, by combining this decreasing force with a force increasing with the distance the output means is pulled, different resulting forces can be obtained. According to a preferred feature of the invention, the decreasing force and increasing force are combined such that the resulting force is a constant force, which is independent on load impulses and -speeds/accelerations.

When the output means is connected to a rotation means, a constant torque is obtained around the axis of rotation of the rotating means.

As regards training, the constant force/torque provided by the present invention gives anatomically and physiologically natural desirable combinations of muscle load forces and the derivates (speeds or accelerations) of the muscle contraction length, which combinations are preferably easily pre-set. The device according to the invention enables a controlled and regular training of a given muscle strength. Further the device according to the invention is extremely effective for training of the explosive muscle strength, which is very important for top athletes. It is accomplished by allowing the muscles to contract with a given or maximum acceleration or speed with a given muscle load. Thereby a widened area of use is obtained from rehabilitation to body-building and competition sport.

Further the present invention can provide a totally mechanical device, which can be arbitrary positioned in space and is neither bully nor heavy, but rather portable and easy to transport and further cost effective to manufacture and maintain.

These and other aspects of, and advantages with, the present invention will be apparent from the following detailed description and from the accompanying drawings.

BRIEF DESCRIPTION OF THE DRAWINGS

In the detailed description reference will be made to the accompanying drawings, of which

DETAILED DESCRIPTION OF THE INVENTION

Figure 1:
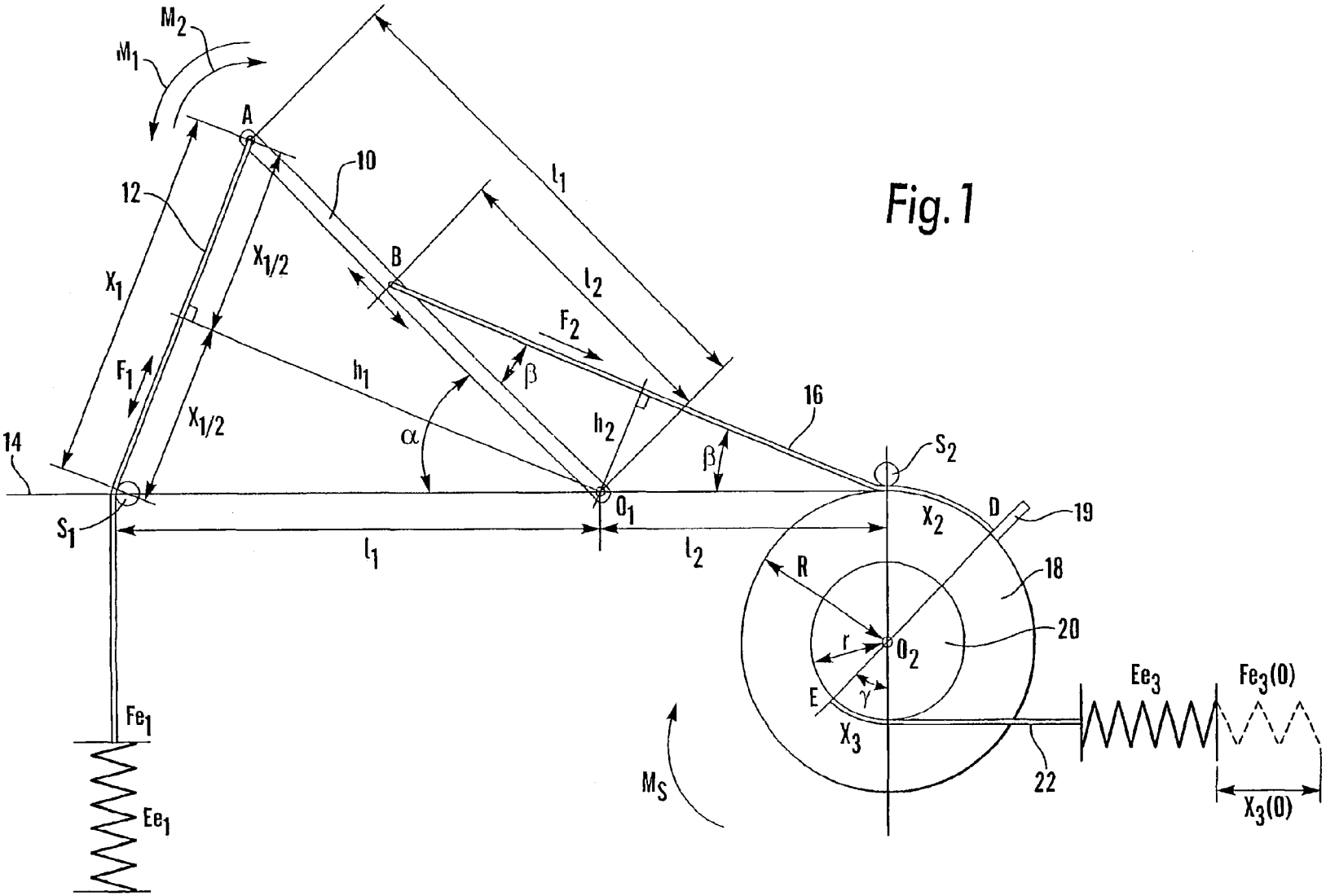
FIG. 1 shows schematically the principle of the present invention where a constant torque is obtained.

The principle according to the present invention will be described in conjunction with the device shown in FIG. 1. It comprises an arm 10 with a length $l_1$ rotatably attached with one end to a shaft $O_1$. The area of rotation $\alpha$ is within a range $0 \leqq \alpha \leqq \pi$ radians. A flexible but inelastic band 12, hereafter named first band, is attached to the free end A of the arm. It is to be understood that the wording "flexible but inelastic" is meant to define a band or wire that is substantially free of elasticity in the longitudinal direction of the band but can be bent in the transversal direction. The band runs downwards over a pulley wheel $S_1$, which pulley wheel is arranged on a horizontal plane 14 in FIG. 1, which plane intersects the axis of rotation of the arm 10 and with the same distance between the pulley wheel and the axis of rotation as the length of the arm $\mathbf{1}_1$=A $O_1$=$S_1O_1$. The first band is attached to an elastic element $Ee_1$.

When turning the arm 10 clock-wise an angle $\alpha$, the portion of first band 12 which is between the pulley wheel and the attachment to the arm, has a length $X_1$, and it is equal to the extension of the elastic element $Ee_1$. In the band 12 an elastic force is then created according to formula $$Fe_1=K_1 \cdot X_1 \tag{1}$$

where $K_1$ is the elasticity coefficient for the elastic element.

A second flexible, but inelastic, band 16 is fixated to the arm 10 at a point B between the axis of rotation $O_1$ and the attachment point A for the first band. The attachment point B of the arm lies on $I_2$ distance from the axis of rotation $O_1$. It can be somewhat adjustable along the arm, for reasons that will be explained below. The second band is led via a second pulley wheel $S_2$, which also is placed on the above mentioned horizontal plane with the distance $l_2$ from the axis of rotation $O_1$ of the arm (i.e. $BO_1=S_2O_1$), to a wheel 18, hereafter named first wheel, where the second band is attached to the periphery of the wheel at a point D. A stop member 19 is arranged on the periphery of the first wheel to come in contact with the second pulley wheel $S_2$ in order to prevent the first wheel from turning anti-clockwise. Thus, the initial position of the device according to FIG. 1 is when the stop member is in contact with the second pulley wheel. Other types of stop members are of course possible in order to obtain the desired function.

In order to get the proper function of the device, the described elements must be geometrically arranged so that in any position of the arm 10, both bands must be always in the touch (by being tangent to or by braking over) with the corresponding pulley wheels ($S_1$ and $S_2$). The first wheel is rotatably arranged to a shaft $O_2$ and has a radius R. The first wheel is so positioned that its upper peripheral surface as seen in FIG. 1, is tangent to the above-mentioned horizontal plane 14. During turning of the first wheel clock-wise with an angle $\gamma$, the other band is wound with a length $X_2=R \cdot \gamma$.

Thereby the other band 16 is tensioned with a certain force $F_2$. In the initial position ($\gamma=0$) the other band is loosely tensioned with a force F2=±0.

During rotation of the first wheel, i.e. pulling of the second band 16 with a length $X_2$ the arm 10 is forced to turn clock-wise around its shaft $O_1$ a certain angle $\alpha$. This turning means in turn that the arm 10 pulls the first band 12 a distance $X_1$ in that the first elastic element $Ee_1$ is extended. In the first band an elastic force according to equation (1) is obtained.

The forces in the first and second band 12, 16 each create torques counteracting each other. In a stationary position these torques are equal, ie $M_1=Fe_1 \cdot h_1=M_2=F_2 \cdot h_2$. If $Fe_1$ is substituted with equation (1) one obtains:

$$K_1 \cdot X_1 \cdot h_1=F_2 \cdot h_2 \tag{4}$$

From the geometry, the following equations may be formulated:

$$\beta=\alpha/2 \tag{5}$$

$$h_1=L_1 \cdot \cos(\alpha/2)=L_1 \cdot \cos \beta \tag{6}$$

$$h_2=L_2 \cdot \sin \beta \tag{7}$$

$$(X_1/2)=L_1 \cdot \sin(\alpha/2)=L_1 \cdot \sin \beta$$

ie.

$$X_1=2 \cdot L_1 \cdot \sin(\alpha/2)=2 \cdot L_1 \cdot \sin \beta \tag{8}$$

$$(BS_2/2)=L_2 \cdot \cos \beta \tag{9}$$

$$X_2=2 \cdot L_2-BS_2 \tag{10}$$

From the equations (9) and (10) is obtained:

$$X_2=2 \cdot L_2-2 \cdot L_2 \cdot \cos \beta, \text{ and}$$

$$\cos \beta=(2 \cdot L_2-X_2)/(2 \cdot L_2) \tag{11}$$

If cos $\beta$ from equation (11) is inserted into equation (6), one obtains:

$$h_1=L_1 \cdot (2 \cdot L_2-X_2)/(2 \cdot L_2) \tag{12}$$

If the variables in equation (4) are substituted with equations (12), (7) and (9), one obtains:

$$K_1 \cdot 2 \cdot L_1 \cdot \sin \beta \cdot L_1 \cdot (2 \cdot L_2-X_2)/2 \cdot L_2=F_2 \cdot L_2 \cdot \sin \beta.$$

ie $$F_2=K_1\cdot L_1^2\cdot(2\cdot L_2-X_2)/L_2^2=K_1\cdot(L_1/L_2)^2\cdot(2\cdot L_2-X_2)$$
$$=2\cdot K_1\cdot L_1^2/L_2-K_1\cdot(L_1/L_2)^2\cdot X_2 \quad (13)$$

As can be seen from equation (13) in the area of $0\leqq X_2\leqq 2\cdot L_2$ $F_2$ is a linearly decreasing as $X_2$ becomes larger, i.e. as the second band is pulled further and further. This further provides a linearly decreasing torque around the shaft O2 as the first wheel is turned according to $M_{2o2}=F_2\cdot R$.

A second wheel 20 is attached to the first wheel and also rotatably arranged to the shaft $O_2$. The second wheel 20 has a radius r, that in the embodiment shown is smaller than the radius R of the first wheel. A third flexible but inelastic band 22 is with one end attached to the periphery of the second wheel at a point E. The other end of the third band is attached to a second flexible element $Ee_3$. The second wheel is geometrically so positioned that the band 22 always is in tangent with the second wheel at the point where the band first touches the wheel surface. During clock-wise turning of the second wheel an elastic force is obtained in the third band according to $$Fe_3=K_3\cdot(X_3+X_3(0)) \quad (2)$$

where $X_3(0)$ is the resilience of $Fe_3$ during initial position ($\gamma=0$, i.e. $X_3=0$), which creates the pre-tension force $K_3\cdot X_3(0)$. The pre-tensioning is made possible because of the stop member 19 in contact with the first pulley wheel. $Fe_3$ is thus linearly increasing as the band 22 is pulled. A linearly increasing torque $M_3=Fe3\cdot r$ is thus obtained.

The first and the second wheels 18, 20 are used in order to summarize a linearly decreasing torque $M_{2o2}$ with a linearly increasing torque $Me_3$ around the shaft $O_2$ in a way, and for a purpose, which will be described below.

If one assumes that a torque Ms is applied to both wheels and turns them simultaneously with a certain angle γ radians clockwise, as is shown in FIG. 1, the second band 16 is wound up on the first wheel 18 with a length $X_2=R\cdot\gamma$, and the third band 22 is wound up on the second wheel 20 with a length $X_3=r\cdot\gamma$, then the following equation is valid as:

$$Ms=M_3+M_{2o2}=$$
$$M_s=R\cdot F_2+r\cdot F_3=R\cdot F_2+r\cdot K_3\cdot(X_3+X_3(0)) \quad (3)$$

The resulting torque Ms that the forces $F_2$ and $F_3$ exert around the shaft $O_2$ according to equation (3) can thus be expressed as $$Ms=2\cdot R\cdot K_1\cdot L_1^2/L_2-R\cdot K_1\cdot(L_1/L_2)^2\cdot X_2+r\cdot K_3\cdot(X_3+X_3(0))=$$
$$2\cdot R\cdot K_1\cdot L_1^2/L_2-R\cdot K_1\cdot(L_1/L_2)^2\cdot X_2+r\cdot K_3\cdot X_3+r\cdot K_3\cdot X_3(0)=$$
$$2\cdot R\cdot K_1\cdot L_1^2/L_2-R\cdot K_1\cdot(L_1/L_2)^2\cdot R\cdot\gamma+r\cdot K_3\cdot r\cdot\gamma+r\cdot K_3\cdot X_3(0)=$$
$$2\cdot R\cdot K_1\cdot L_1^2/L_2+r\cdot K_3X_3(0)+(r^2\cdot K_3-R^2\cdot K_1\cdot(L_1/L_2)^2)\cdot\gamma \quad (14)$$

In order to obtain a torque that is independent of the turning angle γ, ie constant, then $$r^2\cdot K_3-R^2\cdot K_1\cdot(L_1/L_2)^2=0$$
$$(r/R)^2\cdot(K_3/K_1)=(L_1/L_2)^2, \text{ or}$$
$$K_3/K_1=(L_1\cdot R/(r\cdot L_2))^2 \quad (15)$$

At the prerequisite that the parameters in equation (15) fulfil the equation the constant torque will then be:

$$Ms=2\cdot R\cdot K_1\cdot L_1^2/L_2+r\cdot K_3\cdot X_3(0) \quad (16)$$

where $0\leqq X_3(0)\leqq X_3(0)\max$

The range within which the torque Ms can be set is thus $$Ms_{min}=2\cdot R\cdot K_1\cdot L_1^2/L_2$$
$$Ms_{max}=2\cdot R\cdot K_1L_1^2/L_2+r\cdot K_3\cdot X_3(0)\max$$
$$\mu=(Ms_{max}-Ms_{min})/Ms_{min}=$$
$$=r\cdot K_3\cdot X_3(0)\max/(2\cdot R\cdot K_1\cdot L_1^2/L_2) \quad (17)$$

where μ is a given design parameter which defines the ratio between the variable part and the fixed part of the torque Ms and is intended for the dimensioning of $X_3(0)\max$, ie.

$$X_3(0)\max=(2\cdot R\cdot K_1L_1^2/L_2\cdot\mu)/(r\cdot K_3) \quad (18)$$

Figure 2:
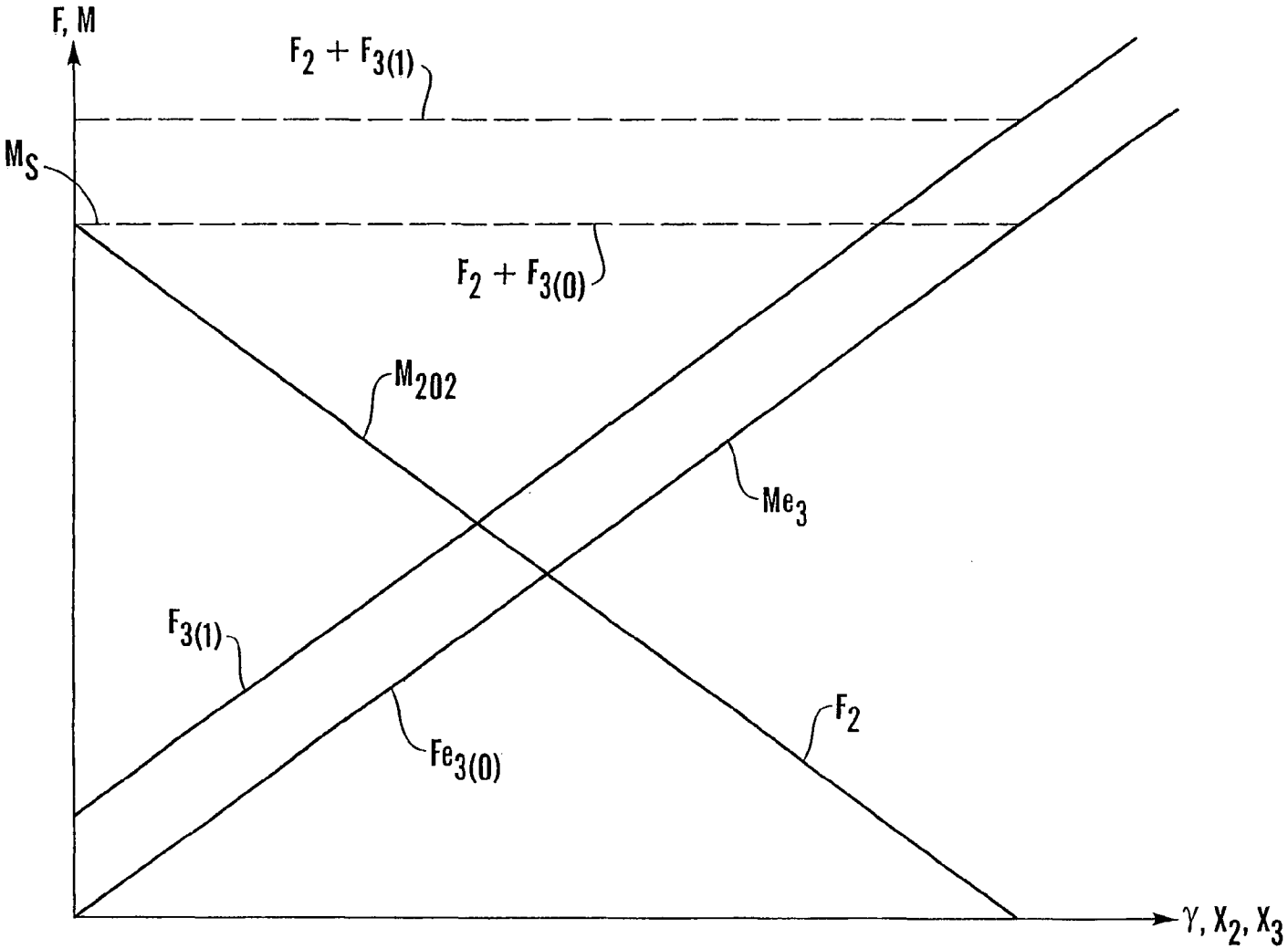
FIG. 2 shows a diagram over the forces acting in the present invention.

With a suitable mechanical design $X_3(0)$ can be varied with a desired precision. FIG. 2 shows the two torques as a function of the turning angle γ and the summation in order to obtain the constant torque Ms. As can be seen from the figure, the inclination of the two torques should be the same but with opposite signs in order to obtain the constant torque Ms. This is obtained by the suitable choice of the figuring parameters ($K_3$, $K_1$, $L_1$, R, r and $L_2$) which satisfies the equation 15. However due to influences such as smaller deviations of the parameters of the equation 15, from the calculated values, it might be necessary to adjust one or more suitable parameters of the equation 15 in order to obtain a constant torque. This may for example be done by adjusting the attachment point B along the arm 10 somewhat.

As can be seen from FIG. 2, and as can be noted from the above, the level of the torque Ms can be pre-set by changing the pre-tension of the elastic element $Ee_3$.

Figure 3:
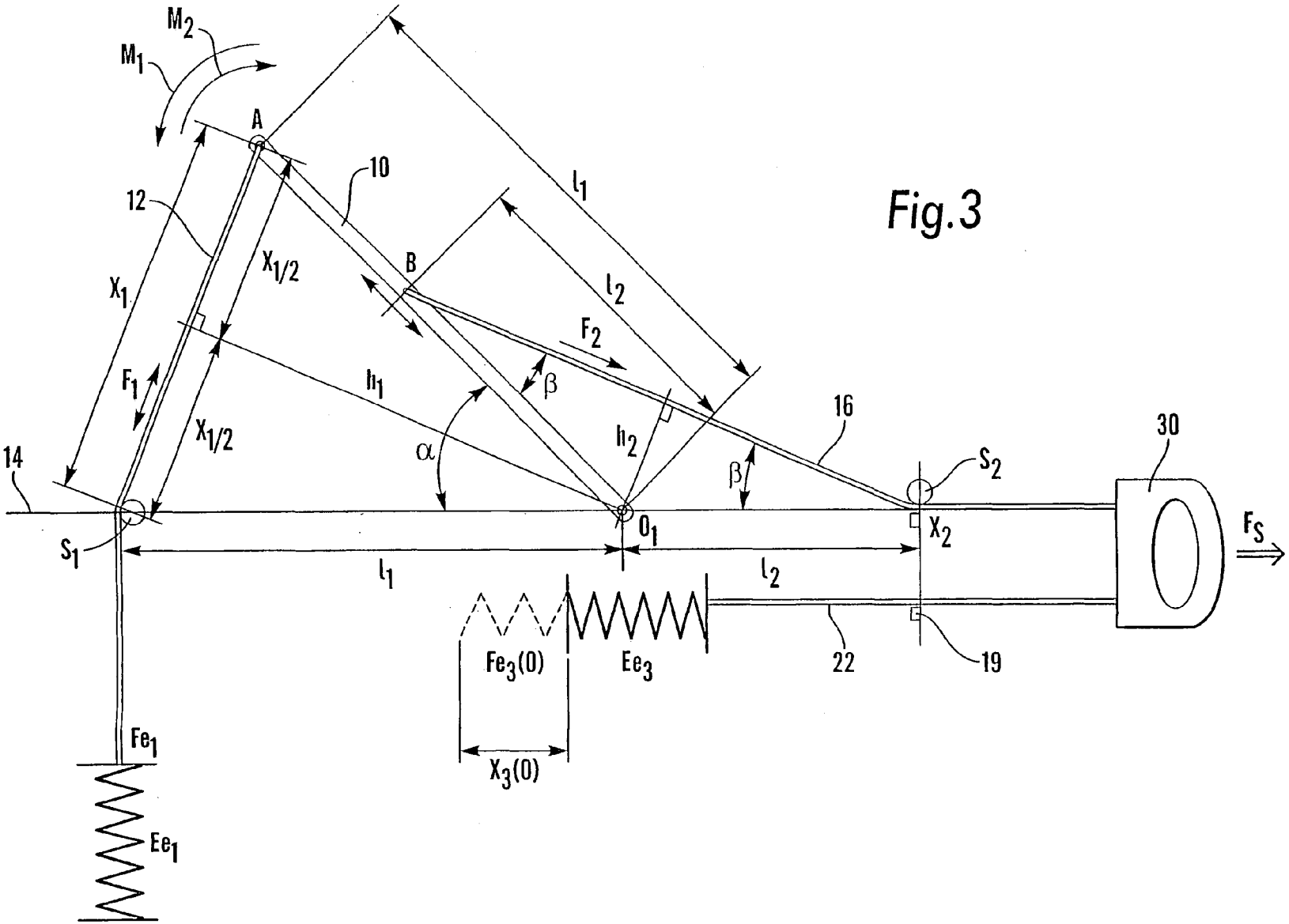
FIG. 3 shows schematically the principle of the present invention where a constant force is obtained.

A few examples of choice of dimensions:

1. If one chooses R=r and $L_1=L_2=X_3(0)\max=L$, then equation is fulfilled with $K_1=K_3=K$ and $Ms=R\cdot K\cdot(2L+X_3(0))$, $Ms_{min}=2\cdot R\cdot K\cdot L$, $Ms_{max}=3\cdot R\cdot K\cdot L$
2. If one chooses R=r and $L_1=2\cdot L_2=X_3(0)\max=L$ then $K_3=4\cdot K_1=4\cdot K$, and
   $Ms=4\cdot R\cdot K\cdot(L+X_3(0))$,
   $Msmin=4\cdot R\cdot K\cdot L$, $Msmax=8\cdot R\cdot K\cdot L$ FIG. 3 shows another summation device. Instead of a rotating wheel, a handle 30 or the like means may be employed in order to obtain a constant linear force Fs. Also here a stop member 19 is arranged in order to prevent the handle from moving beyond an initial position and to enable the pre-tensioning of the second flexible element.

$$Fs=F_2+F_3 \quad (19)$$
$$=2\cdot K_1\cdot L_1^2/L_2-K_1\cdot(L_1/L_2)^2\cdot X_2+K_3\cdot(X_3+X_3(0))$$

Both bands are pulled simultaneously. Therefore they always pass the same distance at a time i.e.:

$$X_2=X_3=X \quad (20)$$

$$Fs=2\cdot K_1\cdot L_1^2/L_2-K_1\cdot(L_1/L_2)^2\cdot X+K_3\cdot(X+X_3(0)) \quad (21)$$
$$=2\cdot K_1\cdot L_1^2/L_2-K_1\cdot(L_1/L_2)^2\cdot X+K_3\cdot X+K_3\cdot X_3(0))$$
$$=2\cdot K_1\cdot L_1^2/L_2+K_3\cdot X_3(0))+(K_3-K_1\cdot(L_1/L_2)^2)\cdot X$$

The condition for the constant value of Fs is if the coefficient in the front of X is zero i.e.:

$$K_3-K_1\cdot(L_1/L_2)^2=0$$

Or $$K_3/K_1=(L_1/L_2)^2 \quad (22)$$

Then the constant value of Fs is:

$$Fs=2\cdot K_1\cdot L_1^2/L_2+K_3\cdot X_3(0)) \quad (23)$$

where the value of this constant is pre-set by changing the distance of $X_3(0)$).

Figure 4:
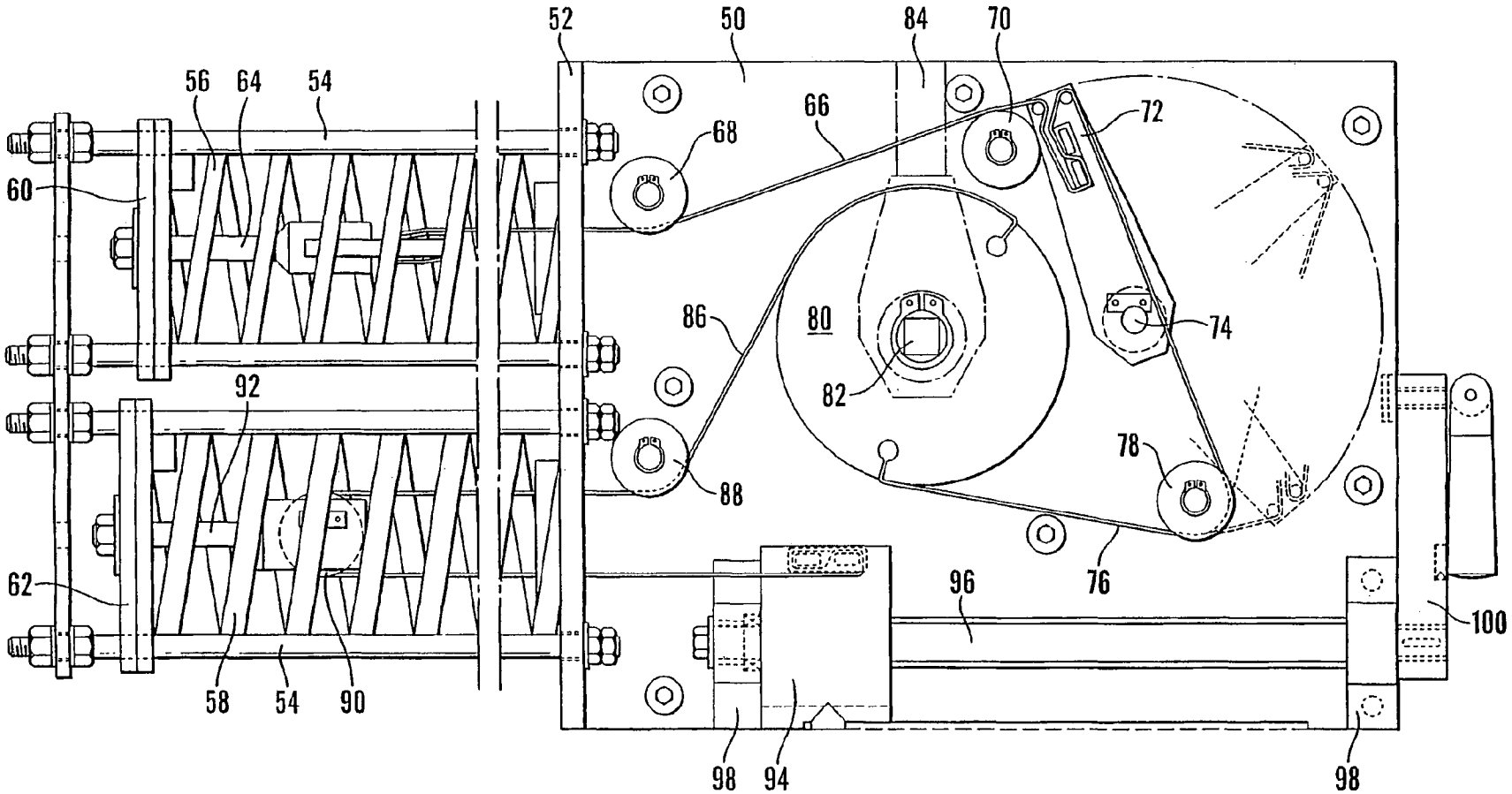
FIG. 4 shows one embodiment of a device according to the principle of FIG. 1.

FIG. 4 shows a practically realised and tested embodiment comprising the principle described above. The embodiment is intended as exercise equipment for training of muscles, The device comprises a base plate or a frame 50 of a rigid material. A side wall 52 is fixedly attached to the base plate. A number of guide rods 54 are attached to the side wall forming two sets of guide posts. Within each set of guide posts a compression spring is arranged, 56, 58, which compression springs are in contact with the side wall and a respective pressure plate 60, 62. The pressure plates are arranged movable along the guide rods and guided by them. To the upper pressure plate 60 as seen in FIG. 4 a pull rod 64 is attached, extending inside the spring in the longitudinal direction of the spring. A non-elastic but flexible band or wire 66 is attached to the pull rod. The band runs around a first pulley wheel 68, which is rotatably arranged to the base plate, then around a second pulley wheel 70, rotatably arranged to the base plate. The second pulley wheel corresponds to the wheel $S_1$ of FIG. 1. The end of the band is attached to the end of an arm 72, which arm is rotatably arranged around a shaft 74 attached to the base plate.

The arm corresponds to the arm 10 of FIG. 1. A second non-elastic but flexible band or wire 76 is attached to the same end of the arm as band 66. The second band runs around a third pulley wheel 78, corresponding to the wheel $S_2$ of FIG. 1, and is attached to the peripheral surface of a wheel 80, which wheel is attached to a shaft 82, which in turn is rotatably attached to the base plate. A stop member (not shown) is arranged to prevent the wheel 80 to rotate anti-clockwise more than the initial position shown in FIG. 4. An exercise handle 84, shown with broken lines in the figure, can be attached to the shaft. Drive moment is obtained by turning the handle 84 clockwise.

A third non-elastic but flexible band or wire 86 is with one end attached to the peripheral surface of the wheel. The third band runs via a fourth pulley wheel 88 around a fifth pulley wheel 90, which is rotatably attached to a pull rod 92 arranged to the second spring 58. The second pull rod is attached to the pressure plate 62. The third band then runs to a fastening element 94 onto which the other end of the third band is attached. The fastening element consists of a rectangular plate or block, through which a threaded hole is arranged. A threaded shaft 96 is arranged through the hole and is rotatably supported at each end by bearings 98. One end of the threaded shaft is protruding outside the base plate, and is provided with a handle 100 for turning the threaded shaft. When turning the handle, the pre-tension of the second spring can be adjusted as desired.

The equation 15 is satisfied by the selection of parameters as follows:

$$R=r,\ K_3=K_1 \text{ and } L_1=L_2$$

Both springs are of the same length and can be equally maximally elastically compressed.

As can be understood from the above described principle of the invention, it can provide other forces/torques as a function of the turning angle.

Since the force $F_2$ is linearly decreasing as a function of the distance $X_2$, and the turning angle $\gamma$ in the embodiment of FIG. 1, this can be used in different areas. One such area is a door-closing device. If one assumes that a door is arranged with its hinges at position $O_2$, the more the door opens, is turned clock-wise in the figure, the less is the torque that tries to close the door. When closing the door, the closing force becomes stronger the more the door is closed.

With another arrangement, the principle may also be used with bows and cross-bows. If one assumes that the band 16 is a string on a bow and the bow itself is the elastic element $Ee_1$ the more the string is pulled the less force is required to pull it. On the other hand, when the string is released, the force driving the arrow will increase.

The force $F_1$ may also be used with the principle according to the present invention in order to obtain other types of torques. If the band 16 is disconnected from the arm 10, the torque $M_1$ acting around the pivoting point O1 is a sinusoidal function of the turning angle $\alpha$ in the area $0 \leqq \alpha \leqq \pi$.

This may be proved in that if quantities from the equations (6) and (8) are placed in the expression for the torque $M_1$ (the left part of equation (4)), one obtains $$M_1=Fe_1\cdot h_1=K_1\cdot X_1\cdot h_1=$$

$$=K_1\cdot 2L_1\cdot \sin\beta\cdot L_1\cdot \cos\beta=K_1\cdot L_1^2\cdot \sin 2\beta=$$

$$=K_1\cdot L_1^2\cdot \sin\alpha \quad (24)$$

This function can be used when there is a mainly sinusoidal relation between the strain on the muscle and its related joint momentum, for example the force in the biceps and the momentum on the lower arm. The momentum then creates a nearly constant muscle strain.

The embodiments of the invention as described above and shown in the drawings are to be regarded as non-limiting examples and that the invention is defined by the scope of the claims. As an example, the springs may be substituted with other elastic means such as rubber bands, gas filled pistons and the like.

One other area of use where constant force is desirable is medicine:

for example the dosage of liquids, such as syringes, where the plunger is to be pressed into the barrel of the syringe with a constant speed/force.

Or

Pulling a traumatised limb after an orthopaedic treatment, with the given force, which is independent of, displacement or jerk of the limb.

The invention claimed is:

1. A device for obtaining a predetermined linear force, comprising:

a first elastic force means;

a first force output means in the form of a non-elastic, flexible elongated member; and a force transformation means arranged between said first elastic force means and the first force output means, such that a pulling of the first force output means creates a tension in said first elastic force means, wherein the force transformation means is arranged and designed such that the pulling force required on the first force output means decreases with a distance the first force output means is pulled, wherein said force transformation means includes an arm pivotably arranged to a shaft, said first elastic force means is attached to said arm, and said first force output means is attached to said arm with one end, wherein a first direction changing means is arranged in contact with said first force output means between said one end and a pulling end, and wherein a distance between a pivoting point and the attachment point of said first force output means and said arm is substantially equal to a distance between the pivoting point and said first direction changing means.

2. The device according to claim 1, further comprising:

a second non-elastic, flexible elongated member arranged between said first elastic means and said arm, a second direction changing means arranged in contact with said second member between an attachment point to the first elastic means and an attachment point to said arm, wherein a distance between a pivoting point and an attachment point of said second member to said arm is substantially equal to a distance between the pivoting point and said second direction changing means.

3. The device according to claim 1, wherein said first and second direction changing means are pulley wheels.

4. The device according to claim 1, wherein the pulling end of said first force output means is attached to a rotation means rotatable around a shaft at a distance in order to obtain a torque decreasing with a turning angle.

5. The device according to claim 1, further comprising a second elastic force means and a second force output means attached to said second elastic force means, wherein a pulling force required on the second force output means increases with a distance the second force output means is pulled, wherein the first and second force output means are connected to each other such as to summarize the forces, and wherein characteristics of the first and second elastic force means are chosen such that the pulling force is substantially constant during the pulling distance.

6. The device according to claim 5, further comprising means for pre-tensioning said second elastic force means.

7. The device according to claim 5, wherein the pulling end of said first force output means is attached to a rotation means rotatable around a shaft at a distance, wherein the pulling end of said second force output means is attached to said rotation means at a distance such that a torque is obtained which is constant during turning of said rotation means.

8. The device according to claim 5, wherein the device is to be used as an exercise equipment.

9. The device according to claim 1, wherein the first elastic force means include springs.

* * * * *